US005501370A

United States Patent [19]

Okamura et al.

[11] Patent Number: 5,501,370

[45] Date of Patent: Mar. 26, 1996

[54] CONTAINER WITH NOZZLE CAP

[75] Inventors: Naomi Okamura, Kuki; Takao Hino, Yokohama; Akio Nimura, Kawaguchi; Masayuki Fukai, Chofu; Keizi Shimizu, Osaka; Harumi Teramae, Takarazuka; Chiaki Hata, Ibaraki, all of Japan

[73] Assignee: Taoka Chemical Company, Limited, Tokyo, Japan

[21] Appl. No.: 277,110

[22] Filed: Jul. 20, 1994

[30] Foreign Application Priority Data

Jul. 23, 1993 [JP] Japan ..... 5-202811

[51] Int. Cl.[6] ..... B67D 3/00

[52] U.S. Cl. ..... 222/111; 222/91; 222/105; 222/546; 222/551; 222/568

[58] Field of Search ..... 222/111, 105, 222/108, 215, 91, 546, 551, 554, 562, 568; 215/13.1, 12.1, 33, 35; 220/444, 450, 225

[56] References Cited

U.S. PATENT DOCUMENTS

| | | | |
|---|---|---|---|
| 1,561,298 | 11/1925 | Baldwin | 222/551 |
| 2,873,886 | 2/1959 | Miskel et al. | 222/91 |
| 3,240,405 | 3/1966 | Abbott | 222/546 X |
| 3,362,587 | 1/1968 | Postel | 222/551 X |
| 3,724,722 | 4/1973 | Ballo | 222/105 |
| 3,848,780 | 11/1974 | Stull | 222/546 |
| 3,945,381 | 3/1976 | Silver | 222/562 X |
| 4,143,797 | 3/1979 | Reed | 222/546 X |
| 4,635,823 | 1/1987 | Stull | 222/108 |
| 4,863,067 | 9/1989 | Krall | 222/111 |

FOREIGN PATENT DOCUMENTS

| | | | |
|---|---|---|---|
| 214707 | 1/1957 | Australia | 222/562 |
| 0210052 | 1/1987 | European Pat. Off. | 222/215 |
| 2515534 | 5/1983 | France | 222/091 |
| 58-8682 | 2/1983 | Japan . | |
| 62-44914 | 11/1987 | Japan . | |
| 404339769 | 11/1992 | Japan | 222/105 |
| 6191545 | 7/1994 | Japan . | |
| 404525 | 6/1966 | Switzerland | 222/546 |
| 670025 | 4/1952 | United Kingdom | 222/562 |

*Primary Examiner*—Andres Kashnikow
*Assistant Examiner*—Kenneth Bomberg
*Attorney, Agent, or Firm*—Birch, Stewart, Kolasch & Birch

[57] ABSTRACT

The present invention relates to an improvement of a nozzle cap for a composite container containing a low-viscosity liquid such as a humidity-curing type adhesive of α-cyanoacrylate-based adhesive, solvent-volatile type adhesive, various chemicals, food, and ink. A container is provided with a nozzle cap which includes a nozzle connected to a container body and a cap threadably mounted to the nozzle for closing a discharge port of the nozzle. A head of the cap is provided with a column element projecting inwardly for closing the nozzle and a head of the column element is provided with a concave hole into which the tip of the nozzle is removably inserted or fitted. A superior, unique effect is exhibited such that the closure of the nozzle is easily and completely performed, and adhesive or the like adhering to the tip of the nozzle does not spread around and cure, thereby preventing formation of an umbrella- or mushroom-shaped solid material.

20 Claims, 7 Drawing Sheets

Fig. 1-a
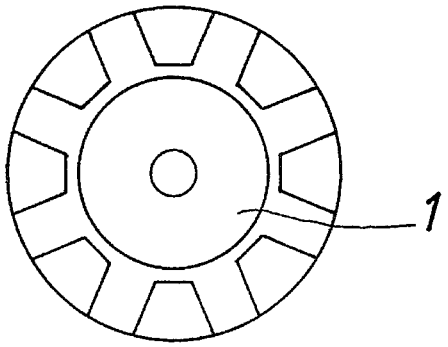
Fig. 1-b
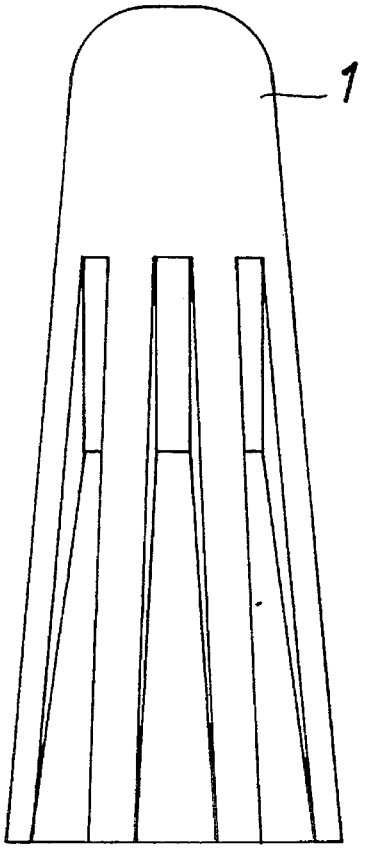

Fig. 2-a
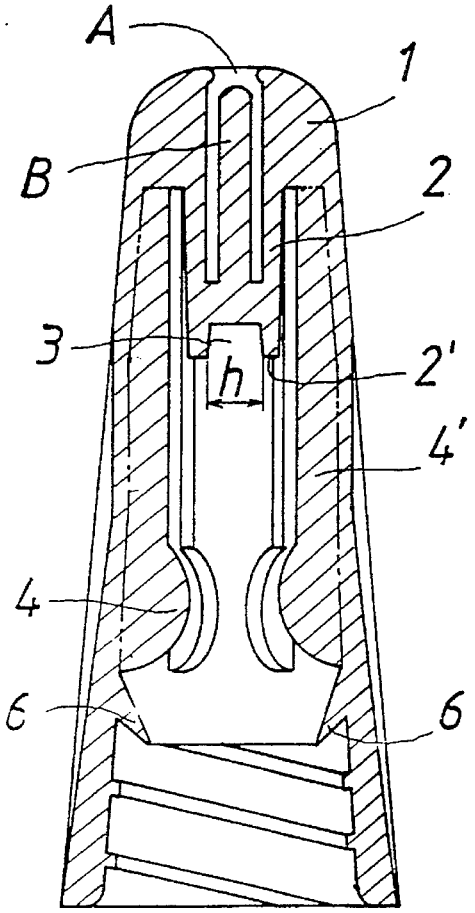
Fig. 2-b
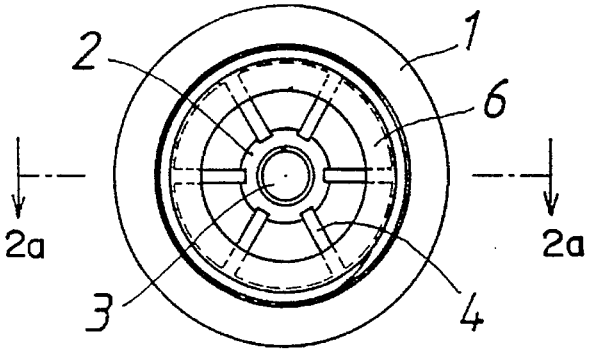

Fig. 3-a
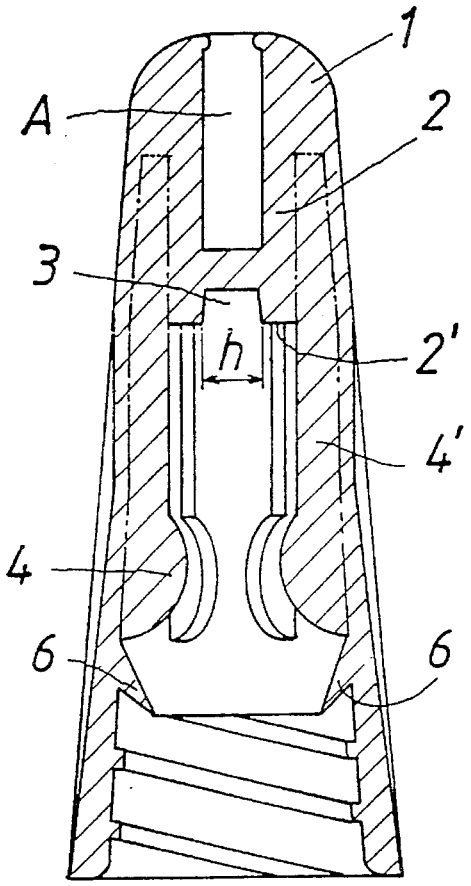
Fig. 3-b
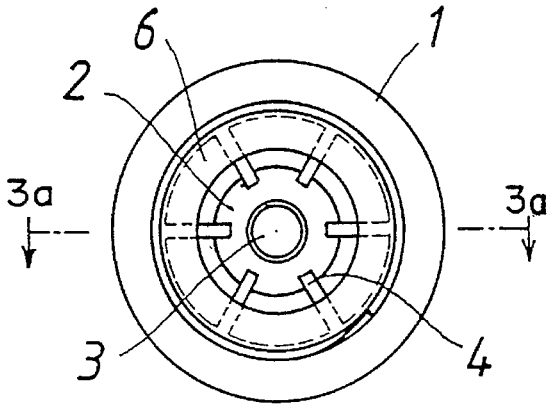

Fig. 4-a
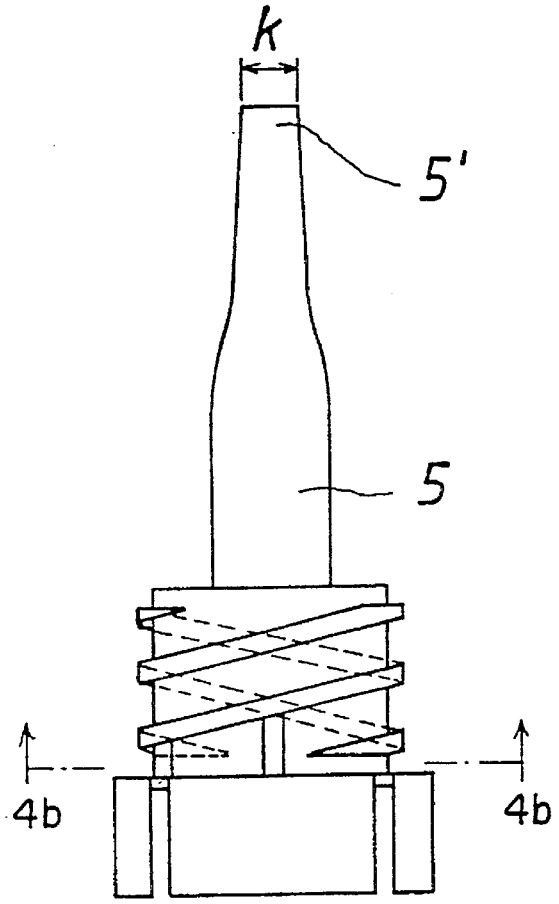
Fig. 4-b
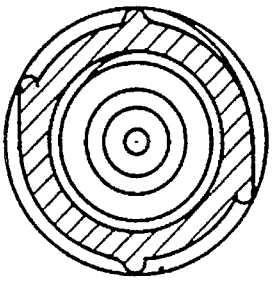

Fig. 5-a
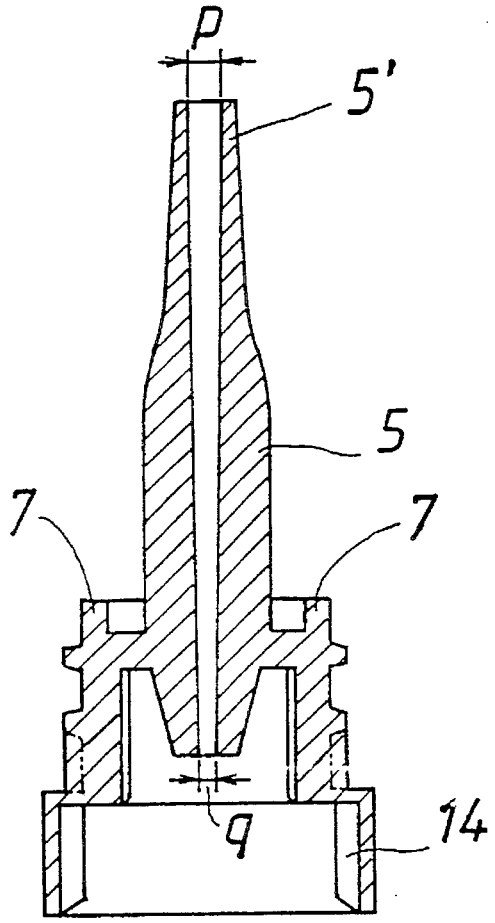
Fig. 5-b
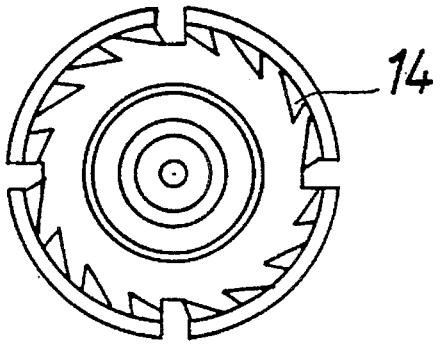

Fig. 7-a
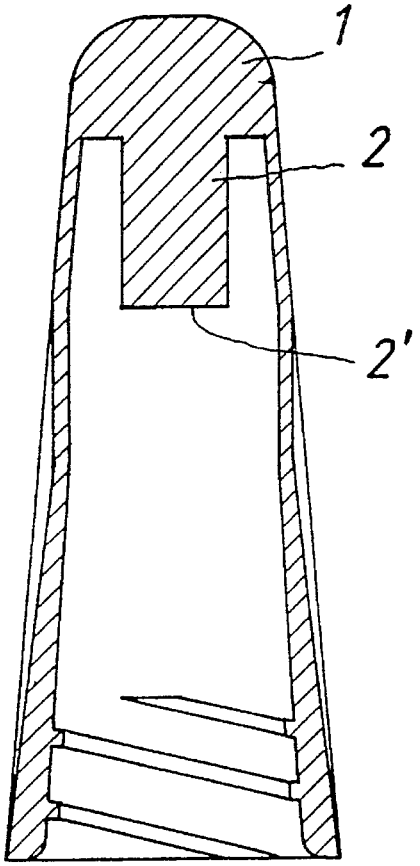
Fig. 7-b
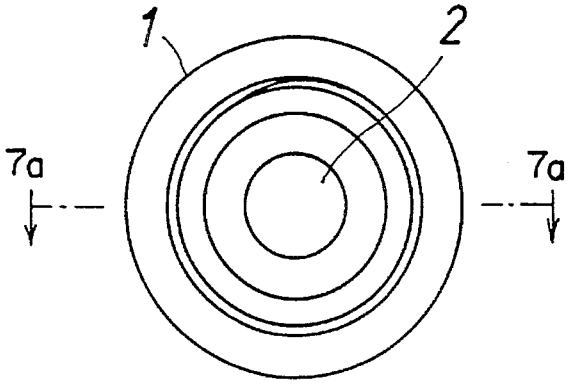

CONTAINER WITH NOZZLE CAP

BACKGROUND OF THE INVENTION

1. Field of the Invention

The present invention relates to an improvement of a nozzle cap for a composite container containing a low-viscosity liquid such as humidity-curing type adhesive, for example, α-cyanoacrylate-based adhesive, solvent-volatile type adhesive, various chemicals, food, and ink.

2. Description of Related Art

Liquid adhesive as a representative of low-viscosity liquid includes different types such as a solvent-volatile type and humidity-curing type, wherein the solvent-volatile type cannot be stored in a plastic tube, and the humidity-curing type also cannot be stored in a humidity-permeative plastic tube. Therefore, the adhesives of these types are conventionally stored in a metallic tube such as an aluminum tube and a lead tube.

However, a metallic tube which has no restoring force, after discharging the adhesive contents, causes a so-called liquid trickle. For example, where the contents such as those of instant adhesive are of a low viscosity, such a phenomenon becomes more apparent. Also, a metallic tube which has no restoring force leaves concavities as it is used, thereby causing its use to become difficult and its appearance to be deformed and become bad. Further, a metallic tube cannot be allowed to stand, so that in order to prevent the contents from flowing out when the tube is laid horizontally in the course of use, a cap must be applied to the tube each time the tube is laid down, thereby becoming troublesome to a user. In addition, where the contents are small in quantity, a problem exists in that a metallic tube is small in size and thus difficult to handle.

In order to solve these problems, as disclosed, for example, in Japanese Examined Utility Model SHO 58-8682 and Japanese Examined Utility Model SHO 62-44914, a fitted mounting of a cylindrical elastic tube or a pipe-shaped plastic on the outer periphery of a metallic tube is proposed.

However, the proposed method is such that the elastic restoring force of the elastic tube or the pipe-shaped plastic allows the metallic tube to be restored and thus a discharged liquid accumulated in its outlet to be sucked, so that the restoring property is not sufficient and thus the sucking force for sucking the discharged liquid is weak. Particularly, a problem exists in that the restoring properties become weak as the tube is used, thereby causing the application purpose to be not sufficiently achieved.

As a result of concentrated research, the present inventor and others have previously invented, as a composite container for a low-viscosity liquid to solve these problems, a composite container which includes an inner container having a body containing contents and a mouth portion for discharging the contents from the body, and an outer sheath container for sheathing the body of the inner container, which allows a pressure medium to be interposed between the inner container and the outer sheath container (Japanese Patent Application HEI 4-198963).

According to the previous invention, the pressure medium causes the restoring force of the outer sheath container to be transmitted to the inner container and thus the restoring properties of the inner container to be sufficiently improved, thereby allowing the liquid trickle to be prevented and the contents to be completely discharged.

However, in the composite container for a low-viscosity liquid in connection with the previous invention, where the container is constructed such that a nozzle is threadably attached to the mouth portion of the inner container and that a cap for closing a discharge port of the nozzle is threadably engaged with the nozzle, if the cap is strongly and threadably tightened, if a discharged liquid having dropped on the outer periphery of the nozzle causes the cap to adhere to the nozzle, or if a discharged liquid having dropped on the outer periphery of the nozzle cures to cause a rise to be formed on the outer peripheral surface of the nozzle, when the cap is removed, the nozzle may be turned together with the cap, thereby causing the nozzle to be threadably disengaged from the mouth portion of the inner container.

Due to this fact, taking the above-mentioned circumstances into consideration, the present inventor and others have previously invented a composite container which prevents its cap from being threadably tightened and more strongly than a predetermined force, and its nozzle from being turned together when the cap is threadably disengaged (Japanese Patent Application HEI 4-348251).

The previous invention is a composite container for a low-viscosity liquid which includes an inner container having a body containing contents and a mouth portion threadably mounted to a nozzle for discharging the contents from the body, an outer sheath container for sheathing the body of the inner container, the nozzle threadably mounted to the above-mentioned mouth portion, and a cap for closing a discharge port of the above-mentioned nozzle, characterized in that in order to achieve the above-mentioned purpose, the outer sheath container is provided with a boss through which a base end of the mouth portion is inserted and which forms ratchet teeth on the outer peripheral surface thereof, while the above-mentioned nozzle is provided with ratchet internal teeth corresponding to said ratchet teeth.

In this previous invention, a cap, for example, as shown in FIGS. 7*a* and 7*b* is used, in which case the closure of the nozzle portion is performed by closing a tip of the nozzle by a head plane 2' of a column element 2 projecting inwardly in a head 1 of the cap. With this method, the closure of the nozzle is insufficient in some cases. That is, adhesive or the like adhering to the tip of the nozzle spreads around and cures to form the so-called umbrella- or mushroom-shaped solid material to cause a discharge tip to become thick, whereby the container becomes difficult to use such that precision coating becomes impossible, and thus higher sealing properties are required, in which case the closure cannot be considered to be sufficient. As a concentrated research to solve these problems, the present invention has been completed.

SUMMARY OF THE INVENTION

The present invention is a container with a nozzle cap which includes a nozzle connected to a container body containing contents and a cap for closing a discharge port of the nozzle, characterized in that a head of the cap is provided with a column element projecting inwardly for closing the nozzle and that a head of the column element is provided with a concave hole into which the tip of the nozzle is removably inserted.

Also, the present invention is a container with a nozzle cap which includes a nozzle connected to a container body containing contents and a cap threadably mounted to the nozzle for closing a discharge port of the nozzle, characterized in that a head of the cap is provided with a column element projecting inwardly for closing the nozzle and that a head of the column element is provided with a concave hole into which the tip of the nozzle is removably inserted.

Further, the present invention is a container with a nozzle cap characterized in that in the above-mentioned case, three or more nozzle guiding ribs are protrusively provided on the inside of the cap.

The most preferable aspect of the present invention is a container with a nozzle cap which includes a nozzle connected to a container body containing contents and a cap threadably mounted to the nozzle for closing a discharge port of the nozzle, characterized in that a head of the cap is provided with a column element projecting inwardly for closing the nozzle, that a head of the column element is provided with a concave hole into which the tip of the nozzle is removably inserted, and that three or more nozzle guiding ribs are protrusively provided on the inside of the cap.

Further, the present inventor has found it more preferable to apply the above-mentioned nozzle and cap of the present invention to the above-mentioned previous invention, that is, the invention which includes an inner container having a body containing contents and a mouth portion for discharging the contents from the body, and an outer sheath container for sheathing the body of the inner container, and which allows a pressure medium to be interposed between the inner container and the outer sheath container, and to the invention which in the above case, the outer sheath container is provided with a boss thorough which a base end of the mouth portion is inserted and which forms ratchet teeth on the outer peripheral surface thereof, while the above-mentioned nozzle is provided with internal ratchet teeth corresponding to the ratchet teeth.

That is, in a composite container which includes an inner container having a body containing contents and a mouth portion threadably mounted to a nozzle for discharging the contents from the body, an outer sheath container for sheathing the body of the inner container, the nozzle threadably mounted to the inner container, and a cap for closing a discharge port of the nozzle; a pressure medium is selectively interposed between the inner container and the outer sheath container; a head of the cap is provided with a column element projecting inwardly for closing the nozzle; a head of the column element is provided with a concave hole into which the tip of the nozzle is removably inserted; and three or more nozzle guiding ribs are protrusively provided on the inside of the cap, or in this case, the outer sheath container is provided with a boss thorough which a base end of the mouth portion is inserted and which forms ratchet teeth on the outer peripheral surface thereof, while the above-mentioned nozzle is provided with internal ratchet teeth corresponding to the ratchet teeth; whereby the container becomes a superior composite container having advantages such as superior preserving stability in addition to the so-called one-touch opening/sealing and one-drop by one-push.

BRIEF DESCRIPTION OF THE DRAWINGS

FIG. 1*a* is a top plan view of a cap of the present invention;

FIG. 1*b* is a front view of a cap of the present invention;

FIG. 2*a* is a sectional view taken along line 2*a*—2*a* of FIG. 2*b* of a cap of the present invention;

FIG. 2*b* is a bottom plan view of a cap of the present invention;

FIG. 3*a* is a sectional view taken along line 3*a*—3*a* of FIG. 3*b* of a cap of the present invention;

FIG. 3*b* is a bottom plan view of a cap of the present invention;

FIG. 4*a* is a front view of a nozzle of the present invention;

FIG. 4*b* is a sectional view taken along line 4*b*—4*b* of FIG. 4*a* of a nozzle of the present invention;

FIG. 5*a* is a front sectional view of a nozzle of the present invention;

FIG. 5*b* is a bottom view of a nozzle of the present invention;

FIG. 7*a* is a sectional view taken along line 7*a*—7*a* of FIG. 7*b* of the nozzle cap in the conventional art; and FIG. 7*b* is a bottom plan view of a nozzle cap of the conventional art.

DETAILED DESCRIPTION OF PREFERRED EMBODIMENTS

Figure 6:
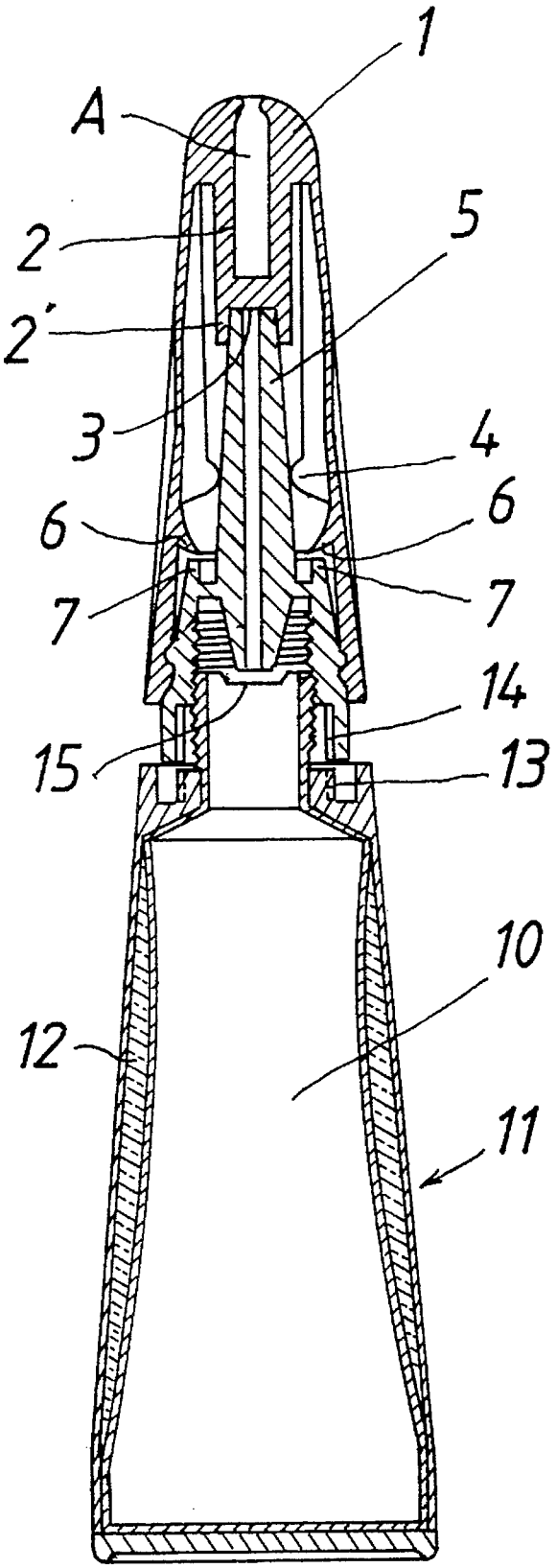
FIG. 6 is a front sectional view of a composite container to help explain a state in which a nozzle cap of the present invention is applied to a previous invention.

With reference to the drawings, the present invention will be explained in detail hereinafter.

FIGS. 1 through 3 are views showing an example of a cap for a nozzle of the present invention, in which FIG. 1*a* is a top plan view; FIG. 1*b* is a front view thereof; FIG. 2*b* is a bottom plan view; and FIG. 2*a* is a sectional view taken along line 2*a*—2*a* of FIG. 2*b*. FIG. 3 is a modification of FIG. 2, in which FIG. 3*b* is a bottom view; and FIG. 3*a* is a sectional view taken along line 3*a*—3*a* of FIG. 3*b*.

FIGS. 4 through 5 are views showing an example of a nozzle of the present invention, in which FIG. 4*a* is a front view; FIG. 4*b* is a sectional view taken along line 4*b*—4*b* of FIG. 4*a;* FIG. 5*a* is a sectional view thereof; and FIG. 5*b* is a bottom view thereof.

The present invention, as shown in FIG. 2*a,* is characterized in that a head 2' of a column element 2 is provided with a concave hole 3 into which a tip 5' of a nozzle 5 is removably inserted or fitted. Thus, these characteristics provide superior nozzle closing properties, and eliminate a fact that adhesive or the like adhering to the tip of the nozzle spreads around and cures to form an umbrella-shaped or mushroom-shaped solid material.

In the present invention, it is required that the tip of the nozzle must be inserted or fitted into the concave hole 3, and the shape of the hole is preferably wider at its inlet and narrower at its bottom, that is, the so-called trapezoid as shown in FIG. 2*a*. Specifically, the inside diameter (h in FIG. 2*a*) of the bottom of concave hole 3 provided on the head of the column element is made smaller than the outside diameter (k in FIG. 4*a*) of the tip 5' of the nozzle.

Also, the present inventor has found that it is more preferable with respect to the contact properties and sealing properties with the nozzle that the shape of the bottom of the concave hole 3 is a smooth, spherical shape having a rise rather than a linear shape.

Thus, a fact that the threaded tightening of the cap causes the concave hole cut out in the column element to be forcedly opened, and/or the flexibility and cushioning action of the column element itself allow complete closing properties to be maintained. Also, there is an effect of removing a deposit on the tip of the nozzle.

Considering these effects, as a material of the column element to be used, a relatively soft material, specifically, a low- to medium-density polyethylene is preferably applied.

As shown in FIGS. 2*a* and 3*a,* a cavity portion (A) is provided to a column element projecting inwardly in the head of the cap 1, which is preferable for the above-mentioned flexibility and cushioning properties, has a function of further improving the closing properties of the nozzle, and includes a superior advantage such that a deformation will hardly occur in actual molding of the cap, and which is thus one of more preferable embodiments of the present invention.

FIG. 2*a* shows a state is which a pillar (B) is set up in the cavity portion (A) of the column element, which is provided to further improve molding properties and is not particularly restrictive.

With the above-mentioned description, the column element 2 of the present invention is not required to be a true column element, and may be substantially columnar, triangular or square as a modification thereof. However, considering the fitting properties with the nozzle, the shape of the concave hole 3 of the head 2' of the column element is preferably circular, and particularly, a truncated cone is one of the most preferable embodiments.

FIGS. 4 through 5 show an example of a nozzle of the present invention. The shape of the nozzle, though not particularly restrictive, has the same diameter up to the middle of the length thereof and a smaller diameter at the tip thereof as shown in FIG. 4, which is one preferable aspect due to a fact that such a shape improves the contact properties of the cap with guide ribs to allow the nozzle to be correctly capped. Now, in making the diameter of the tip smaller, a sharp decrease in the diameter causes a step difference, so that problems occur such that the step difference becomes obstructive when using the nozzle, making it difficult to perform a centering at the tip of the nozzle, and that such shape easily causes a fatigue and the like and thus is unsuitable for precisional dropping/coating work. Therefore, the present inventor has found that the shift from the larger diameter up to the middle to the smaller diameter at the tip is provided with a smooth curve, specifically, a gradient developed by a continuous curve by two circles, whereby the step difference is eliminated to solve the above-mentioned problems, and that the shape is thus more preferable. FIGS. 4 through 5 show such a preferred shape.

The inside diameter of the nozzle is made smaller at its base and somewhat larger as its tip is reached, which is one preferable aspect with respect to clogging prevention (p>q in FIG. 5*a*).

As a material of the nozzle used in the present invention, though not particularly restrictive thereto, a material relatively harder than that of the cap is usually preferable, and for example, a low- to medium-density polyethylene is preferably used.

Second characteristics of the present invention are that as shown in FIGS. 2*a* and 2*b*, a plurality of nozzle guiding ribs 4, 4' are protrusively provided inside the cap 1. As shown in FIG. 2*a*, the shape of the nozzle guiding ribs 4, 4' is preferably mountain-shaped and formed such that the ribs come in contact through a point with the side of the nozzle. This is because the area of the ribs in contact with adhesive or the like adhering to the nozzle is made as small as possible and molding properties are good.

FIG. 2*a* shows a flat mountain-shape having a lower slope in the longitudinal direction inside the cap. However, the shape of the rib is not restrictive, and can be assumed to take various forms such as a simple mountain, triangle, semicircle, trapezoid and rectangle. The flat mountain-shape having a lower slope as shown in FIG. 2*a* is particularly advantageous to the molding properties of cap.

Although the characteristics of the present invention are that at least three nozzle guiding ribs 4, 4' are protrusively provided in the longitudinal direction inside the cap 1, the number of ribs is not restrictive such that it usually ranges from three to eight. In FIG. 2*a*, a case where six ribs are protrusively provided is described.

Although it may be advantageous from the industrial point of view that the nozzle guiding ribs are molded integrally with the cap, the molding method is not restrictive, so that a method of separately fixing them may also be assumed.

Although the thickness of the nozzle guiding rib is suitably determined with respect to molding properties and strength, an excessive thickness is not preferable because it increases contact area.

The nozzle guiding ribs 4, 4' may be molded coupling with the above-mentioned column element 2. For example, as shown in FIG. 3*a* and FIG. 3*b*, the column element 2 may be molded by coupling with the nozzle guiding ribs 4, 4' in which case, however, the flexibility and cushioning properties of the column element 2 tends to decrease somewhat.

In this manner, when the cap is applied to the nozzle, the tip of the nozzle is guided to a correct position and inserted or fitted into the cap, thereby allowing high-degree closing properties to be secured.

FIG. 6 is a front sectional view of a composite container to help explain a state in which a nozzle cap of the present invention is applied to a previous invention, wherein the numeral 10 indicates an inner container body; the numeral 11 an outer sheath container; the numeral 12 a pressure medium; the numeral 13 ratchet teeth; and the numeral 14 inner ratchet teeth.

The container body 10 is usually formed of an aluminum tube, and has a construction such that a male screw tip provided on a mouth portion of the container body is inserted into and threadably mounted to a female screw provided on the lower end of the nozzle 5.

When the nozzle cap 1 is threadably mounted to the nozzle 5, threadably fitted to the nozzle, and threadably tightened to a predetermined depth, the cap is caught by its own outer peripheral surface, whereby the threading of the cap to the nozzle is limited. In a state that the cap is threadably tightened over the nozzle to a predetermined depth in such a manner, when the female screw of the nozzle 5 is threadably fitted and further screwed to the male screw provided on the mouth portion of the inner container 10, a thin film of the mouth portion 15 of the inner container body (usually the aluminum tube) is broken, whereby the inside of the inner container communicates with the discharge path.

When the cap is further screwed, the inner ratchet teeth 14 hit the ratchet teeth 13, and the cap 1 is pushed out in the outer peripheral direction, thereby preventing the cap 1 from being tightened in the nozzle 5 by a force of at least a predetermined value. Thereafter, when the cap 1 is allowed to rotate in the thread disengaging direction, the inner ratchet teeth 14 are locked to the ratchet teeth 13, so that the nozzle 5 becomes impossible to rotate in the thread disengaging direction with respect to the outer sheath container 11, whereby the thread disengaging of the cap 5 together with the cap from the inner container 10 can be surely prevented, and thus the construction is such that only the cap 1 can be removed.

When the cap 1 is uncapped, the peripheral wall of the outer sheath container 11 is held with fingers to press, the peripheral wall of the outer sheath container 11 caves in, and its urging force is transmitted through the pressure medium 12 to the inner container body 10 to cause the inner container to cave in, whereby contents are discharged through the discharge path of the nozzle 5 to the outside.

Although part of the discharged contents remains in the tip portion of the nozzle 5, removing the force urging the outer sheath container 11 causes the outer sheath container 11 and the pressure medium 12 to be elastically restored, and subsequently most of the discharged contents remaining in the tip portion of the nozzle 5 to be sucked back into the nozzle discharge path and the inner container body 10, whereby liquid trickle becomes difficult to occur.

FIG. 7 is a sectional view showing a construction of the nozzle cap in the conventional art. In the conventional art, by the plane 2' of the column element 2 protruding inwardly to the head of the cap, the nozzle tip is closed to cause the nozzle to be closed, in which method problems exist in that the closure of the nozzle is insufficient in some cases, and thus adhesive or the like adhering to the tip of the nozzle may spread around and cure to form the so-called umbrella- or mushroom-shaped solid material, and that when the cap is applied to the nozzle, adhesive or the like adhering to the nozzle adheres to the inner peripheral surface of the cap to cure, thereby causing the cap to become difficult to remove.

On the contrary, according to the present invention, as shown in FIG. 2*a*, the concave hole 3 is provided in the head 2' of the column element 2, into which the tip 5' of the above-mentioned nozzle is removably inserted or fitted, thereby providing superior nozzle closing properties, and eliminating a fact that adhesive or the like adhering to the tip of the nozzle spreads around thereof and cures to form an umbrella- or mushroom-shaped solid material.

Also, the present inventor and others have found that in the container with a nozzle cap of the present invention, liquid stopping eaves 6 are provided on the inner wall peripheral surface of the cap, and a liquid accumulating weir 7 corresponding to the eaves is provided on the nozzle base portion, whereby the container becomes an easy-to-use container with a nozzle cap.

That is, for example, in a container with a nozzle cap containing instant adhesive, when actually used, problems exist in that the adhesive may adhere to the inner wall surface of the cap, and that the adhesive adhering to the wall may flow along the inner wall surface of the cap and finally reach the thread portion of the cap, in which case the adhesive cures to prevent the cap from being removed or reused.

On the contrary, in the present invention, as shown in FIG. 6, the liquid stopping eaves 6 are provided on the inner wall surface of the cap. It is preferable that as shown in FIGS. 6, 2*a* and 3*a*, the liquid stopping portion is made eaves shape having a downward gradient at the lower part of the cap and formed in the so-called ring shape throughout the entire, inner periphery of the cap.

On the other hand, the liquid accumulating weir 7 corresponding to the eaves is provided as a predetermined weir throughout the entire periphery in the base of the nozzle 5, as shown in the above-mentioned FIGS. 6 and 5*a*.

Then, for example, if instant adhesive or the like flows along the wall surface of the cap, the liquid of the adhesive will be guided by the liquid stopping eaves 6 to the liquid accumulating weir 7, thereby preventing the liquid from flowing to the thread portion of the cap. In this manner, problems are eliminated such as curing of the cap to prevent the cap from being removed. The shape of the liquid stopping eaves 6, for example, as shown in 6, 2*a* and 3*a*, is formed such that the tip of the eaves is made thin, whereby effects are obtained such that the flexibility is increased; the degree of freedom becomes large when the cap is threadably mounted to the nozzle to cause the liquid stopping eaves 6 to come in contact with the liquid accumulating weir 7 and thus the tip portion to be fitted; that the fitting properties of the nozzle tip with the concave hole provided in the cap becomes good; and that the sealing properties of the cap are further improved by both the nozzle tip and the concave hole. With the tip of the eaves formed in a thin shape, the tip exhibits a unique effect such that if adhesive cures at the tip, the tip will be deflected due to its flexibility to cause the cap to be easily removed.

According to the present invention, a superior, unique effect is exhibited such that the closure of the nozzle is easily and completely performed, and that adhesive or the like adhering to the tip of the nozzle does not spread around and cure, thereby avoiding formation of the so-called umbrella- or mushroom-shaped solid material.

What is claimed is:

1. A container combined with a nozzle cap comprising a nozzle connected to a body of said container, said nozzle including a tip end and a base end with a discharge port formed within the tip end of said nozzle; and said nozzle cap being made of a resin cap and including a resilient column element projecting into an interior of said cap, said resilient column element having a head end and a base end, the head end of said column element including a concave hole formed therein into which the tip end of said nozzle is removably fitted thereby closing the discharge port of said nozzle, the base end of said resilient column element including a cavity portion longitudinally formed therein for increasing a flexibility of said column element.

2. The container with a nozzle cap as set forth in claim 1, wherein said cap is threadably mounted to said nozzle for closing the discharge port of said nozzle.

3. The container with a nozzle cap as set forth in claim 1, wherein said cap is integrally formed with said column element.

4. The container with a nozzle cap as set forth in claim 1, further comprising liquid stopping eaves having a downward gradient formed on an inner peripheral wall surface adjacent an open end of said cap, and a liquid accumulating weir corresponding to said eaves formed on the base end of said nozzle.

5. The container with a nozzle cap as set forth in claim 1, wherein an inside diameter of the concave hole provided in the head of the column element is smaller than an outside diameter of said nozzle.

6. The container with a nozzle cap as set forth in claim 1, wherein the material of the cap is a low- to medium-density polyethylene.

7. The container with a nozzle cap as set forth in claim 1, further comprising at least three nozzle guiding ribs protrusively provided on an inside surface of said cap.

8. The container with a nozzle cap as set forth in claim 7, wherein said cap and said at least three nozzle guiding ribs are integrally molded.

9. The container with a nozzle cap as set forth in claim 7 or 8, wherein a side of the nozzle guiding ribs are formed such that the ribs are in point contact with a side of said nozzle.

10. The container with a nozzle cap as set forth in claim 7, wherein said nozzle is formed of a low- to medium-density polyethylene.

11. A container with a nozzle cap which includes a nozzle connecting to a container body containing contents and said nozzle cap for closing a discharge port of said nozzle, characterized in that liquid stopping eaves having a downward gradient are provided on an inner peripheral wall surface of a lower part of the nozzle cap, and a liquid accumulating weir corresponding to the eaves is provided on a nozzle base portion.

12. A container combined with a nozzle cap comprising:

a nozzle connected to a body of said container, said nozzle including a tip end and a base end with a discharge port formed in the tip end of said nozzle;

said nozzle cap being made of a resin and closing the discharge port of said nozzle, said cap including an inwardly projecting resilient column element having a head end and a base end, the head end of the column including a concave hole formed therein into which the tip end of said nozzle is removably fitted; and liquid stopping eaves having a downward gradient formed on an inner peripheral wall surface adjacent an open end of said cap, and a liquid accumulating weir corresponding to said eaves formed on the base portion of said nozzle.

13. The container with a nozzle cap as set forth in claim 12, wherein said cap is threadably mounted to said nozzle for closing the discharge port of said nozzle.

14. The container with a nozzle cap as set forth in claim 12, wherein said cap is integrally formed with said column element.

15. The container with a nozzle cap as set forth in claim 12, wherein an inside diameter of the concave hole provided in the head of the column element is smaller than an outside diameter of said nozzle.

16. The container with a nozzle cap as set forth in claim 12, wherein the material of the cap is a low- to medium-density polyethylene.

17. The container with a nozzle cap as set forth in claim 12, wherein further comprising at least three nozzle guiding ribs protrusively provided on an inside surface of said cap.

18. The container with a nozzle cap as set forth in claim 17, wherein said cap and said at least three nozzle guiding ribs are integrally molded.

19. The container with a nozzle cap as set forth in claims 17 or 18, wherein a side of the nozzle guiding ribs are formed such that the ribs are in point contact with a side of

20. The container with a nozzle cap as set forth in claim 12, wherein said nozzle is formed of a low- to medium-density polyethylene.

* * * * *